US010689967B2

(12) United States Patent
Jeffryes et al.

(10) Patent No.: US 10,689,967 B2
(45) Date of Patent: Jun. 23, 2020

(54) ROTATIONAL OSCILLATION CONTROL USING WEIGHT

(71) Applicant: Schlumberger Technology Corporation, Sugar Land, TX (US)

(72) Inventors: Benjamin Peter Jeffryes, Cambridge (GB); Nathaniel Wicks, Somerville, MA (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 220 days.

(21) Appl. No.: 15/588,288

(22) Filed: May 5, 2017

(65) Prior Publication Data

US 2018/0320501 A1 Nov. 8, 2018

(51) Int. Cl.
*E21B 44/04* (2006.01)
*E21B 3/02* (2006.01)

(52) U.S. Cl.
CPC ..... *E21B 44/04* (2013.01); *E21B 3/02* (2013.01)

(58) Field of Classification Search
CPC ..... E21B 44/04; E21B 3/02
USPC ..... 700/160
See application file for complete search history.

(56) References Cited

U.S. PATENT DOCUMENTS 5,507,353 A 4/1996 Pavone
5,713,422 A 2/1998 Dhindsa
8,136,610 B2 3/2012 Jeffryes
2011/0280104 A1* 11/2011 McClung, III ..... E21B 3/02 367/82
2012/0217067 A1* 8/2012 Mebane, III ..... E21B 44/02 175/57
2014/0034386 A1 2/2014 Nessjoen et al.
2014/0360779 A1 12/2014 Kyllingstad
2015/0263575 A1* 9/2015 Pace ..... B66D 1/12 166/355
2016/0047219 A1* 2/2016 Jeffryes ..... E21B 44/00 700/275
2016/0290046 A1 10/2016 Orban et al.
2017/0370203 A1* 12/2017 Hadi ..... G05B 15/02
2019/0040731 A1* 2/2019 Dykstra ..... E21B 44/02

FOREIGN PATENT DOCUMENTS

WO 2011035280 A2 3/2011
WO 2014147575 A1 9/2014

OTHER PUBLICATIONS

Halsey et al., "Torque Feedback Used to Cure Slip-Stick Motion", SPE 18049, 63rd Annual Technical Conference and Exhibition of the Society of Petroleum Engineers, Oct. 1988, pp. 277-282.

* cited by examiner

*Primary Examiner* — James J Lee
*Assistant Examiner* — Michael W Choi
(74) *Attorney, Agent, or Firm* — Rachel E. Greene

(57) ABSTRACT

A method and autodriller for drilling a wellbore with a drill rig by rotating a drillstring and a drill bit with a drill rig drive system; applying an initial weight of the drillstring on the drill rig WOB; measuring drill rig properties to derive an anticipated drill bit rotation speed; and changing the weight of the drillstring on the drill rig WOB so that a corresponding change to the downhole weight on the drill bit occurs approximately simultaneously with a change in the anticipated drill bit rotation speed.

16 Claims, 8 Drawing Sheets

ROTATIONAL OSCILLATION CONTROL USING WEIGHT

TECHNICAL FIELD

The present disclosure relates generally to the field of drilling wells. More particularly, the invention concerns controlling the rotational oscillations of suspended tubulars so as to stabilize the rotational motion of the tubulars used for drilling the well.

BACKGROUND

High amplitude rotational oscillations of the drillstring are a common problem while drilling. They are generated by the combination of the torque generated by the interaction of the bit with the hole-bottom and of the drillstring with the borehole walls, and the lack of damping of the rotational oscillations. One of the reasons that there is so little damping is that the bit-rock interaction does not provide any damping, and indeed can amplify the oscillations.

As explained in SPE 18049, slip-stick motion of the bottom hole assembly can be regarded as extreme, self-sustained oscillations of the lowest torsional mode, called the pendulum mode. Such a motion is characterized by finite time intervals during which the bit is non-rotating and the drill pipe section is twisted by the rotary table or top drive. When the drillstring torque reaches a certain level (determined by the static friction resistance of the bottom hole assembly), the bottom hole assembly breaks free and speeds up to more than twice the nominal speed before it slows down and again comes to a complete stop. It is obvious that such motion represents a large cyclic stress in the drill pipe that can lead to fatigue problems. In addition, the high bit speed level in the problems. In addition, the high bit speed level in the slip phase can induce severe axial and lateral vibrations in the bottom hole assembly which can be damaging to the connections. Finally, it is likely that drilling with slip-stick motion leads to excessive bit wear and also a reduction in the penetration rate. Frequency analysis of the driving torque associated with torsional drillstring vibrations, in particular slip-stick oscillations, reveals that a large number of torsional drillstring resonances. The sharpness of the curve at the drillstring resonance frequencies suggest there is little damping of torsional drillstring vibrations. Halsey, Kyllingstad, and Kylling, "Torque Feedback Used to Cure Slip-Stick Motion," SPE 18049, 1988. The authors proposed a speed correction proportional to the torque to control rotational vibrations.

In WO 2014/147575 (assigned to Schlumberger), a method is described for controlling a drilling system comprising a drive system, drillstring and drill bit. The drive system rotates the drillstring during a drilling process to drill a borehole through an earth formation. The method involves setting a desired rotation speed $v_0$ for the drillstring; receiving property measurements of the drilling system and deriving therefrom the component $v_{up}$ of the rotation speed of the drillstring associated with upgoing rotational energy; determining a rotation speed v for the drillstring by optimizing an expression which reconciles two conflicting objectives of: (i) maintaining a stable rotation speed centered on $v_0$, and (ii) minimizing the downgoing rotational energy, the optimized expression expressing v in terms of $v_0$ and $vu_p$; and controlling the drive system to rotate the drillstring at v. (See WO 2014/147575, abstract).

In U.S. Pat. No. 5,507,353 (assigned to Institut Francais du Petrole), a method and system are described for controlling the behavior of a drill bit that includes an additional resistant torque added to the torque about the drill bit so that the overall torque about the drill bit is an increasing function of the rotary speed of the bit. The system includes control means suited for creating an additional resistant torque about the bit. (See U.S. Pat. No. 5,507,353, abstract). In particular, the patent teaches to change the weight applied to the bit downhole in response to the measurements of the downhole rotation speed.

In U.S. Pat. No. 8,136,610 (assigned to Schlumberger), a method and system are described for drilling a borehole through a medium with a drill bit, a processor, and a controller. The drill bit may be configured to rotate in the medium and remove at least a portion of the medium. The processor may be configured to receive a first set of data representative of a variable rotational speed of the drill bit during a length of time in the medium, and determine, based at least in part on the first set of data, a first resonant frequency of the variable rotational speed of the drill bit. The controller may be configured to receive a second set of data representative of the first resonant frequency of the variable rotational speed of the drill bit, and vary the force applied to the drill bit based at least in part on the second set of data. (See U.S. Pat. No. 8,136,610, abstract). In particular, this patent teaches to avoid exciting the oscillations by filtering the auto-driller control signal to avoid the resonant frequency.

Notwithstanding these prior art technical developments, there is a need for a method and system that reduces or dampens torsional drillstring vibrations, in particular slip-stick oscillations and torsional drillstring resonances.

SUMMARY

In accordance with the teachings of the present disclosure, disadvantages and problems associated with rotational oscillations are overcome by providing a method and system that reduces or dampens torsional drillstring vibrations, in particular slip-stick oscillations and torsional drillstring resonances.

One aspect of the invention is to provide an algorithm, which involves: sensing the downgoing rotation speed at surface; and modifying the WOB coming from the surface, with an appropriate delay so that it will arrive at the same time as changes in downgoing rotation speed.

An aspect of the invention provides a method for drilling a wellbore with a drill rig, the method comprising: rotating a drillstring and a drill bit with a drill rig drive system; applying an initial weight of the drillstring on the drill rig WOB; measuring drill rig properties to derive an anticipated drill bit rotation speed; and changing the weight of the drillstring on the drill rig WOB so that a corresponding change to the downhole weight on the drill bit occurs approximately simultaneously with a change in the anticipated drill bit rotation speed.

According to a further aspect of the invention, there is provided an autodriller for controlling a drill rig system having a drillstring and a drill bit, the autodriller comprising: a rotation receptor that receives a signal corresponding to drillstring rotation speed at the drill rig; a processor; a non-transitory storage medium; and a set of computer readable instructions stored in the non-transitory storage medium, wherein when the instructions are executed by the processor allow the autodriller to: apply an initial weight of the drillstring on the drill rig WOB; measure drill rig properties to derive an anticipated drill bit rotation speed; and change the weight of the drillstring on the drill rig WOB so that a corresponding change to the downhole weight on the drill bit occurs approximately simultaneously with a change in the anticipated drill bit rotation speed.

BRIEF DESCRIPTION OF THE DRAWINGS

A more complete understanding of the present embodiments may be acquired by referring to the following description taken in conjunction with the accompanying drawings, in which like reference numbers indicate like features.

DETAILED DESCRIPTION

Preferred embodiments are best understood by reference to FIGS. 1-9 below in view of the following general discussion. The present disclosure may be more easily understood in the context of a high level description of certain embodiments.

One aspect of the invention is to control the top-drive to reduce stick-slip in a drill rig system for drilling a wellbore. Rotational waves travel up and down the drillstring as the drillsring is rotated in the wellbore. Upgoing rotational waves may be reflected at the surface into downgoing rotational waves, which may lead to large rotational resonances and repetitive stick-slip. In a drillstring with larger pipe near the surface, some of the upgoing rotational waves may be reflected before they reach the surface, which may make surface control of stick-slip even more difficult because the waves are not observable at the surface. The downgoing rotational waves in the drillstring may also include those initiated by the top drive as the top drive rotates the drillstring. One aspect of the invention seeks to achieve a desired drillstring rotation speed at the surface ($v_0$) while minimizing the amount of downgoing energy ($v_{down}$). This formulation fits well as an outer control system driving a fast, built-in control system for the top drive which is attempting to achieve a particular rotation speed. Modern PI top drive controllers (combined with high power top drives) can maintain very tight control over rotation speed. The method and system of the present invention that reduces or dampens torsional drillstring vibrations, in particular slip-stick oscillations and torsional drillstring resonances, may be used with the autodriller illustrated with reference to FIGS. 1 and 2.

Figure 1:
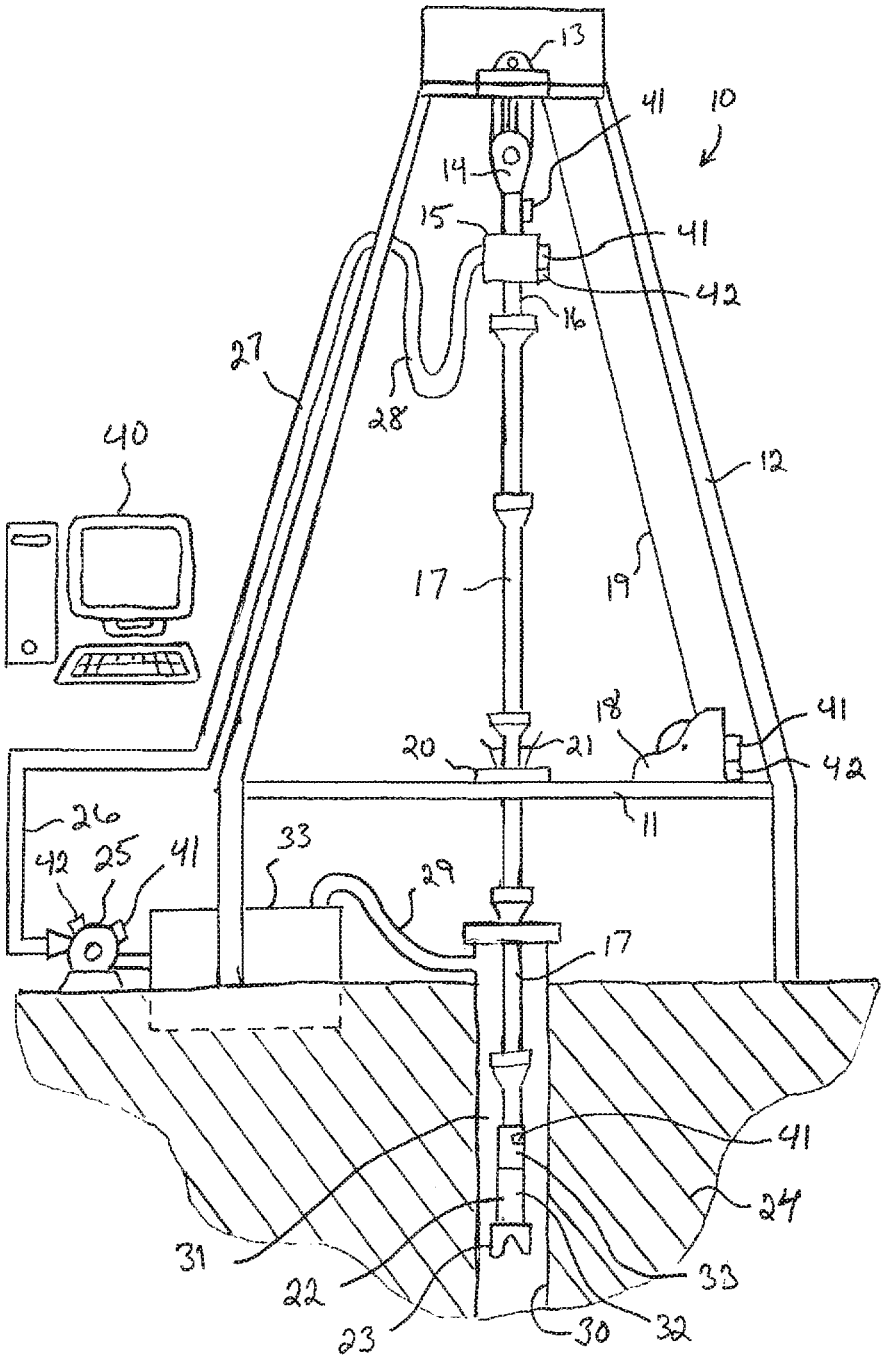
FIG. 1 illustrates a schematic diagram of a drill rig being operated to conduct a drilling operation controlled by an autodriller.

FIG. 1 is a basic diagram of a drill rig 10 in the process of drilling a well. The drilling rig 10 comprises a drilling rig floor 11 that is elevated and a derrick 12 that extends upwardly from the floor. A crown block 13 is positioned at the top of the derrick 12 and a traveling block 14 is suspended therefrom. The traveling block 14 may support a top drive 15. A quill 16 extends from the bottom side of the top drive 15 and is used to suspend and/or turn tubular drilling equipment as it is raised/lowered in the wellbore 30. A drillstring 17 is made up to the quill 16, wherein the drillstring 17 comprises a total length of connected drill pipe stands, or the like, extending into the well bore 30. One or more motors housed in the top drive 15 rotate the drillstring 17. A drawworks 18 pays out and reels in drilling line 19 relative to the crown block 13 and traveling block 14 so as to hoist/lower various drilling equipment.

As shown in FIG. 1, a new stand of drillstring 17 has been made up as the lower portion of the drillstring 17 is suspended from the rig floor 11 by a rotary table 20. Slips 21 secure the suspended portion of the drillstring 17 in the rotary table 20. A bottom hole assembly 22 is fixed to the lower end of the drillstring 17 and includes: a drill bit 23 for drilling through a formation 24; a positive displacement motor (PDM) 32; and a measurement while drilling (MWD) module 33.

During the drilling process, drilling mud may be circulated through the wellbore 30 to remove cuttings from around the drill bit 23. A mud pump 25 pumps the drilling mud through a discharge line 26, stand pipe 27, and rotary hose 28 to supply drilling mud to the top drive 15. Drilling mud flows from the top drive 15 down through the drillstring 17, where it exits the drillstring 17 through the drill bit 23. From the drill bit 23, the drilling mud flows up through an annulus 31 existing between the wellbore 30 and the drillstring 17 so as to carry cuttings away from the drill bit 23. A return line 29 allows the drilling mud to flow from the top of the annulus 31 into a mud pit 33. Of course, the mud pump 25 is supplied drilling mud from the mud pit 33. The drilling mud typically passes through a series of shakers, separators, etc. (not shown) to separate the cuttings from the drilling mud before the mud is circulated again by the mud pump 25.

Referring again to FIG. 1, an autodriller 40 may be used to control the drilling process. The autodriller 40 may be configured to receive drilling parameter data and drilling performance data related to operations of the drilling rig 10. The drilling parameter data and drilling performance data may comprise measurements monitored by a number of sensors 41 placed about the drilling rig 10, e.g., on the drawworks 18, the traveling block 14, the top drive 15, the mud pump 25, and the measurement while drilling (MWD) module 33 as shown in the illustrated embodiment. The sensors 41 may monitor current, voltage, resistivity, force, position, weight, strain, speed, rotational speed, or any other measurement related to drilling parameters or drilling performance, and relevant input may be aggregated as raw sensor measurements or as scaled engineering values. The autodriller 40 may receive drilling parameter data and drilling performance data directly from the sensors 41, retrofitted to certain pieces of equipment on the drilling rig 10, such that the sensors 41 effectively form part of the drilling system. This type of data acquisition may allow for higher sampling rates to be used for monitoring relevant drilling parameters and drilling performance metrics.

Several components of the drill rig 10 may also comprise control actuators 42. For example, the drawworks 18 may comprise an actuator 42 that allows the autodriller 40 to control the workings of the drawworks 18. The top drive 15 and mud pump 25 may also have actuators 42. The actuators 42 allow the autodriller 40 to control various aspects of the drilling process, for example: bit rotation speed, drillstring rotation direction, weight on bit, drilling mud fluid pressure, drilling mud fluid flow rate, drilling mud density, etc. Typically, an autodriller only actuates the drawworks to change the speed at which the drillpipe is being lowered into the well and does not modify flowrate, rotation speed, etc., although an autodriller may be used to modify these parameters as well.

Figure 2:
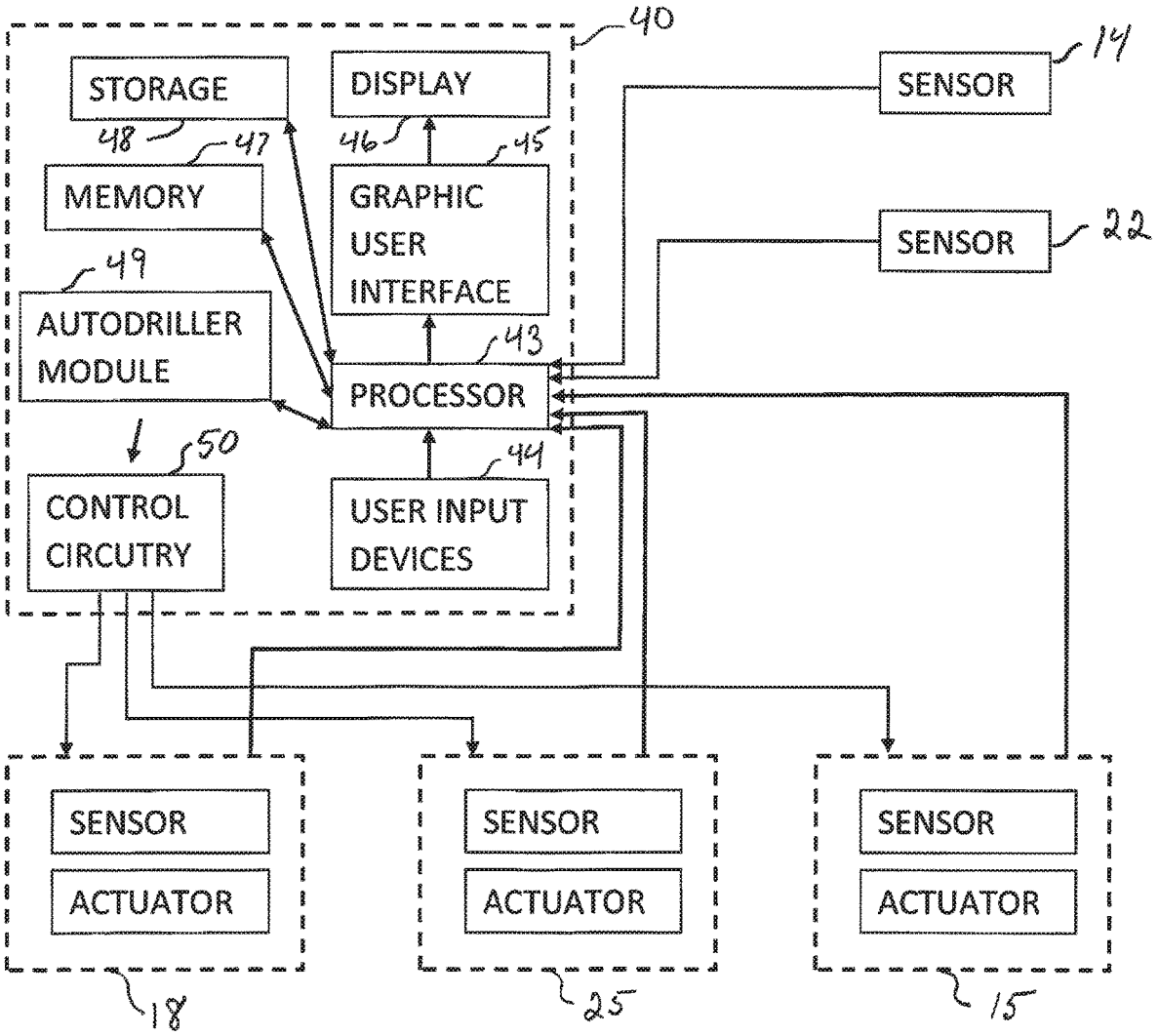
FIG. 2 shows a schematic diagram of an autodriller illustrating various components communicating with each other and with sensors and actuators of the drilling system.

Referring to FIG. 2, a schematic of an autodriller 40 and other drilling rig components is illustrated. The autodriller 40 may comprise a processor 43 that may receive various inputs, such as the drilling parameter data and drilling performance data, from sensors 41. In addition, the processor 43 may be operably coupled to a memory 47 and a storage 48 to execute computer executable instructions for carrying out the presently disclosed techniques. These instructions may be encoded in software/hardware programs and modules that may be executed by the processor 43. The computer codes may be stored in any suitable article of manufacture that includes at least one tangible non-transitory, computer-readable medium (e.g., a hard drive) that at least collectively stores these instructions or routines, such as the memory 47 or the storage 48. An autodriller module 49 may comprise hardware/software for providing autodriller control.

In some embodiments, the autodriller control algorithms may be located in the autodriller module 49. In other embodiments, the autodriller control algorithms may be located on programmable logic controllers (PLCs) that control the drilling rig actuators themselves. In some embodiments, the autodriller control algorithms may be implemented in a software layer above the PLC layer. For example, the autodriller control algorithm would compute the commanded ROP to send to the fast-acting P-I controller on drawworks speed.

Figure 3:
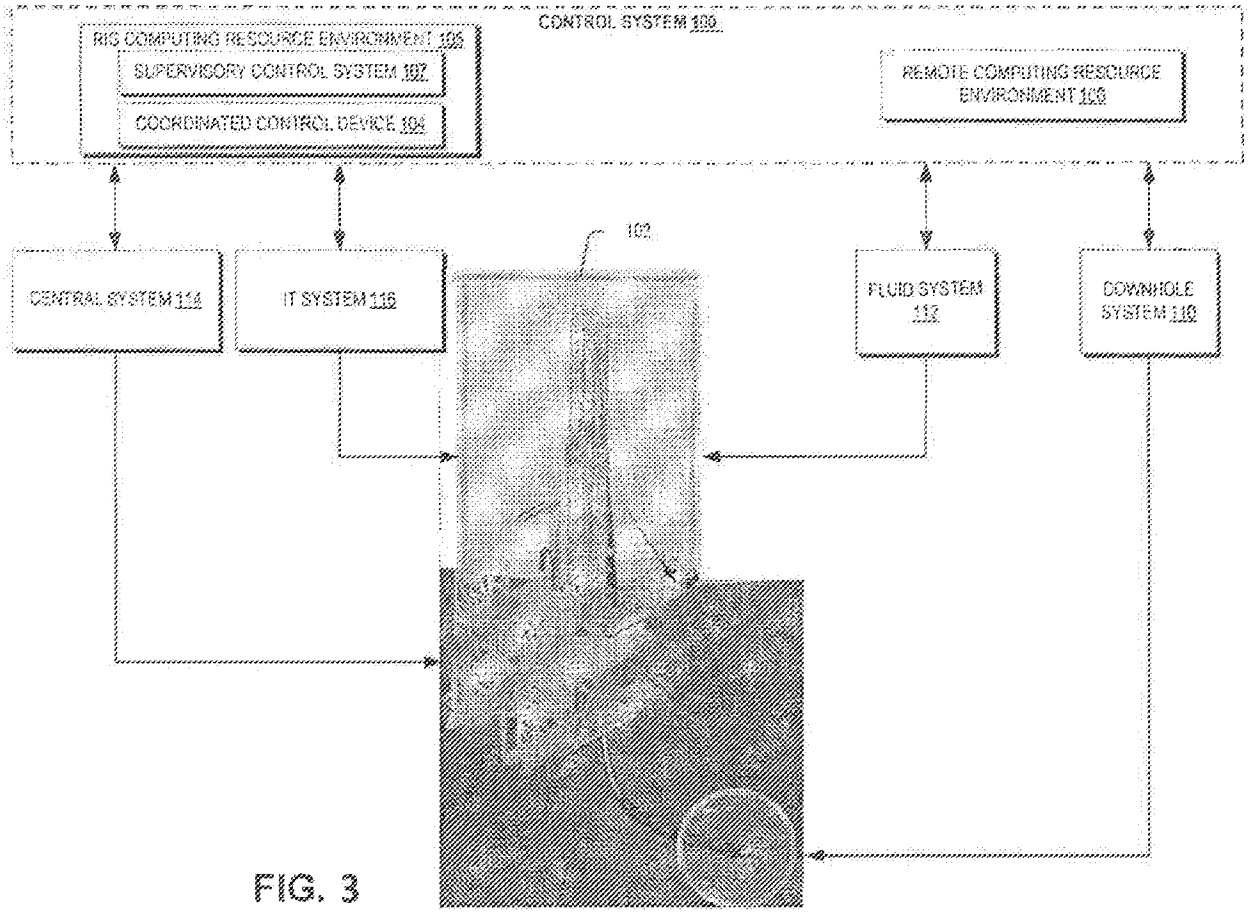
FIG. 3 illustrates a schematic view of a drilling rig and a control system.

The method and system of the present invention that reduces or dampens torsional drillstring vibrations, in particular slip-stick oscillations and torsional drillstring resonances may be used with a rig control system as disclosed in US Publication No. 2016/0290046, incorporated herein by reference in its entirety. FIG. 3 illustrates a conceptual, schematic view of a control system 100 for a drilling rig 102, according to an embodiment. The control system 100 may include a rig computing resource environment 105, which may be located onsite at the drilling rig 102 and, in some embodiments, may have a coordinated control device 104. The control system 100 may also provide a supervisory control system 107. In some embodiments, the control system 100 may include a remote computing resource environment 106, which may be located offsite from the drilling rig 102.

The remote computing resource environment 106 may include computing resources locating offsite from the drilling rig 102 and accessible over a network. A "cloud" computing environment is one example of a remote computing resource. The cloud computing environment may communicate with the rig computing resource environment 105 via a network connection (e.g., a WAN or LAN connection).

Further, the drilling rig 102 may include various systems with different sensors and equipment for performing operations of the drilling rig 102, and may be monitored and controlled via the control system 100, e.g., the rig computing resource environment 105. Additionally, the rig computing resource environment 105 may provide for secured access to rig data to facilitate onsite and offsite user devices monitoring the rig, sending control processes to the rig, and the like.

Various example systems of the drilling rig 102 are depicted in FIG. 3. For example, the drilling rig 102 may include a downhole system 110, a fluid system 112, and a central system 114. In some embodiments, the drilling rig 102 may include an information technology (IT) system 116. The downhole system 110 may include, for example, a bottomhole assembly (BHA), mud motors, sensors, etc. disposed along the drillstring, and/or other drilling equipment configured to be deployed into the wellbore. Accordingly, the downhole system 110 may refer to tools disposed in the wellbore, e.g., as part of the drillstring used to drill the well.

The fluid system 112 may include, for example, drilling mud, pumps, valves, cement, mud-loading equipment, mud-management equipment, pressure-management equipment, separators, and other fluids equipment. Accordingly, the fluid system 112 may perform fluid operations of the drilling rig 102.

The central system 114 may include a hoisting and rotating platform, top drives, rotary tables, kellys, drawworks, pumps, generators, tubular handling equipment, derricks, masts, substructures, and other suitable equipment. Accordingly, the central system 114 may perform power generation, hoisting, and rotating operations of the drilling rig 102, and serve as a support platform for drilling equipment and staging ground for rig operation, such as connection make up, etc. The IT system 116 may include software, computers, and other IT equipment for implementing IT operations of the drilling rig 102.

The control system 100, e.g., via the coordinated control device 104 of the rig computing resource environment 105, may monitor sensors from multiple systems of the drilling rig 102 and provide control commands to multiple systems of the drilling rig 102, such that sensor data from multiple systems may be used to provide control commands to the different systems of the drilling rig 102. For example, the system 100 may collect temporally and depth aligned surface data and downhole data from the drilling rig 102 and store the collected data for access onsite at the drilling rig 102 or offsite via the rig computing resource environment 105. Thus, the system 100 may provide monitoring capability. Additionally, the control system 100 may include supervisory control via the supervisory control system 107.

In some embodiments, one or more of the downhole system 110, fluid system 112, and/or central system 114 may be manufactured and/or operated by different vendors. In such an embodiment, certain systems may not be capable of unified control (e.g., due to different protocols, restrictions on control permissions, etc.). An embodiment of the control system 100 that is unified, may, however, provide control over the drilling rig 102 and its related systems (e.g., the downhole system 110, fluid system 112, and/or central system 114).

Figure 4:
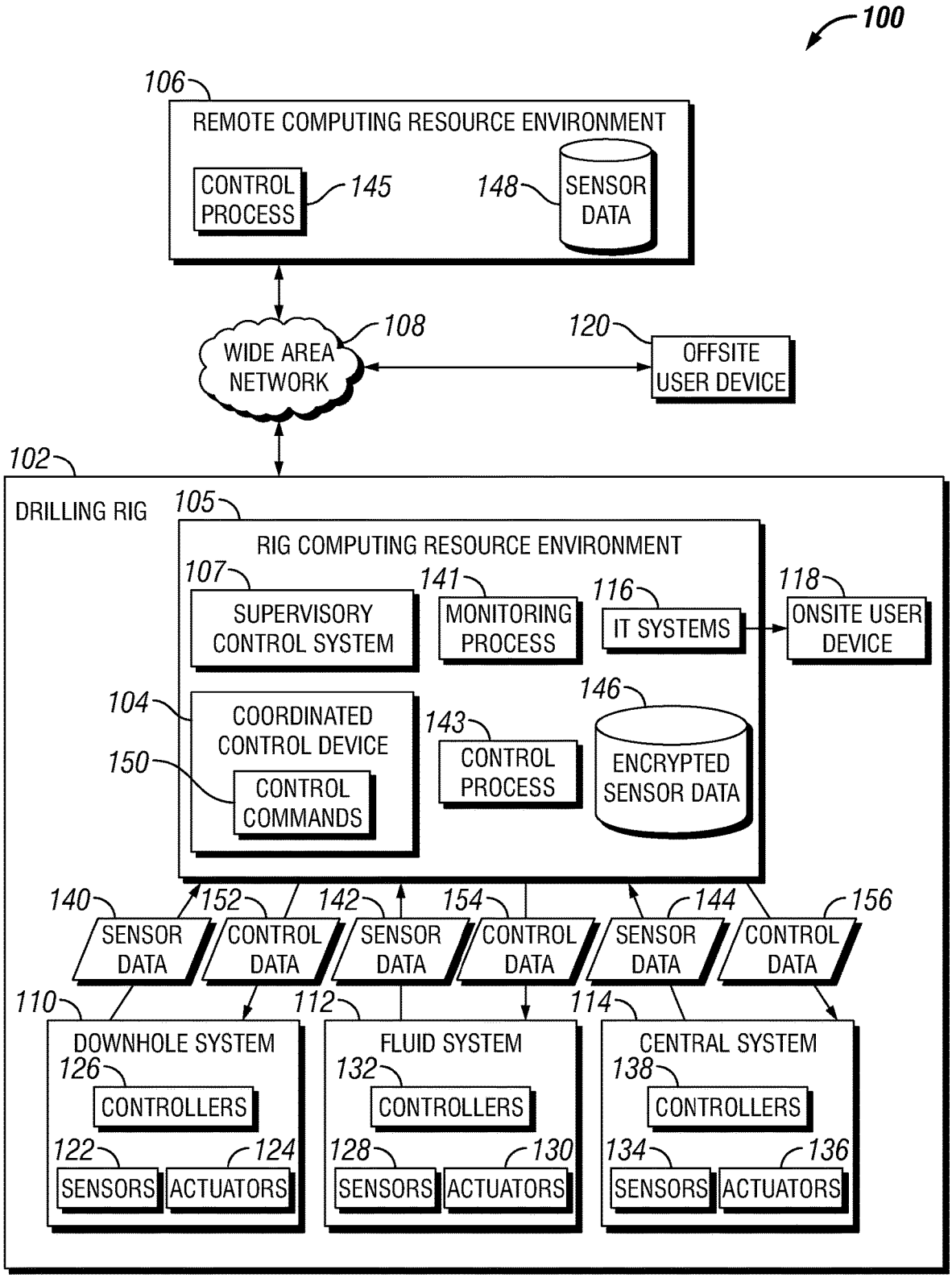
FIG. 4 illustrates a schematic view of a drilling rig and a remote computing resource environment.

FIG. 4 illustrates a conceptual, schematic view of the control system 100, according to an embodiment. The rig computing resource environment 105 may communicate with offsite devices and systems using a network 108 (e.g., a wide area network (WAN) such as the internet). Further, the rig computing resource environment 105 may communicate with the remote computing resource environment 106 via the network 108. FIG. 4 also depicts the aforementioned example systems of the drilling rig 102, such as the downhole system 110, the fluid system 112, the central system 114, and the IT system 116. In some embodiments, one or more onsite user devices 118 may also be included on the drilling rig 102. The onsite user devices 118 may interact with the IT system 116. The onsite user devices 118 may include any number of user devices, for example, stationary user devices intended to be stationed at the drilling rig 102 and/or portable user devices. In some embodiments, the onsite user devices 118 may include a desktop, a laptop, a smartphone, a personal data assistant (PDA), a tablet component, a wearable computer, or other suitable devices. In some embodiments, the onsite user devices 118 may communicate with the rig computing resource environment 105 of the drilling rig 102, the remote computing resource environment 106, or both.

One or more offsite user devices 120 may also be included in the system 100. The offsite user devices 120 may include a desktop, a laptop, a smartphone, a personal data assistant (PDA), a tablet component, a wearable computer, or other suitable devices. The offsite user devices 120 may be configured to receive and/or transmit information (e.g., monitoring functionality) from and/or to the drilling rig 102 via communication with the rig computing resource environment 105. In some embodiments, the offsite user devices 120 may provide control processes for controlling operation of the various systems of the drilling rig 102. In some embodiments, the offsite user devices 120 may communicate with the remote computing resource environment 106 via the network 108.

The systems of the drilling rig 102 may include various sensors, actuators, and controllers (e.g., programmable logic controllers (PLCs)). For example, the downhole system 110 may include sensors 122, actuators 124, and controllers 126. The fluid system 112 may include sensors 128, actuators 130, and controllers 132. Additionally, the central system 114 may include sensors 134, actuators 136, and controllers 138. The sensors 122, 128, and 134 may include any suitable sensors for operation of the drilling rig 102. In some embodiments, the sensors 122, 128, and 134 may include a camera, a pressure sensor, a temperature sensor, a flow rate sensor, a vibration sensor, a current sensor, a voltage sensor, a resistance sensor, a gesture detection sensor or device, a voice actuated or recognition device or sensor, or other suitable sensors.

The sensors described above may provide sensor data to the rig computing resource environment 105 (e.g., to the coordinated control device 104). For example, downhole system sensors 122 may provide sensor data 140, the fluid system sensors 128 may provide sensor data 142, and the central system sensors 134 may provide sensor data 144. The sensor data 140, 142, and 144 may include, for example, equipment operation status (e.g., on or off, up or down, set or release, etc.), drilling parameters (e.g., depth, hook load, torque, etc.), auxiliary parameters (e.g., vibration data of a pump) and other suitable data. In some embodiments, the acquired sensor data may include or be associated with a timestamp (e.g., a date, time or both) indicating when the sensor data was acquired. Further, the sensor data may be aligned with a depth or other drilling parameter.

Acquiring the sensor data at the coordinated control device 104 may facilitate measurement of the same physical properties at different locations of the drilling rig 102. In some embodiments, measurement of the same physical properties may be used for measurement redundancy to enable continued operation of the well. In yet another embodiment, measurements of the same physical properties at different locations may be used for detecting equipment conditions among different physical locations. The variation in measurements at different locations over time may be used to determine equipment performance, system performance, scheduled maintenance due dates, and the like. For example, slip status (e.g., in or out) may be acquired from the sensors and provided to the rig computing resource environment 105. In another example, acquisition of fluid samples may be measured by a sensor and related with bit depth and time measured by other sensors. Acquisition of data from a camera sensor may facilitate detection of arrival and/or installation of materials or equipment in the drilling rig 102. The time of arrival and/or installation of materials or equipment may be used to evaluate degradation of a material, scheduled maintenance of equipment, and other evaluations.

The coordinated control device 104 may facilitate control of individual systems (e.g., the central system 114, the downhole system, or fluid system 112, etc.) at the level of each individual system. For example, in the fluid system 112, sensor data 128 may be fed into the controller 132, which may respond to control the actuators 130. However, for control operations that involve multiple systems, the control may be coordinated through the coordinated control device 104. Examples of such coordinated control operations include the control of downhole pressure during tripping. The downhole pressure may be affected by both the fluid system 112 (e.g., pump rate and choke position) and the central system 114 (e.g. tripping speed). When it is desired to maintain certain downhole pressure during tripping, the coordinated control device 104 may be used to direct the appropriate control commands.

In some embodiments, control of the various systems of the drilling rig 102 may be provided via a three-tier control system that includes a first tier of the controllers 126, 132, and 138, a second tier of the coordinated control device 104, and a third tier of the supervisory control system 107. In other embodiments, coordinated control may be provided by one or more controllers of one or more of the drilling rig systems 110, 112, and 114 without the use of a coordinated control device 104. In such embodiments, the rig computing resource environment 105 may provide control processes directly to these controllers for coordinated control. For example, in some embodiments, the controllers 126 and the controllers 132 may be used for coordinated control of multiple systems of the drilling rig 102.

The sensor data 140, 142, and 144 may be received by the coordinated control device 104 and used for control of the drilling rig 102 and the drilling rig systems 110, 112, and 114. In some embodiments, the sensor data 140, 142, and 144 may be encrypted to produce encrypted sensor data 146. For example, in some embodiments, the rig computing resource environment 105 may encrypt sensor data from different types of sensors and systems to produce a set of encrypted sensor data 146. Thus, the encrypted sensor data 146 may not be viewable by unauthorized user devices (either offsite or onsite user device) if such devices gain access to one or more networks of the drilling rig 102. The encrypted sensor data 146 may include a timestamp and an aligned drilling parameter (e.g., depth) as discussed above. The encrypted sensor data 146 may be sent to the remote computing resource environment 106 via the network 108 and stored as encrypted sensor data 148.

The rig computing resource environment 105 may provide the encrypted sensor data 148 available for viewing and processing offsite, such as via offsite user devices 120. Access to the encrypted sensor data 148 may be restricted via access control implemented in the rig computing resource environment 105. In some embodiments, the encrypted sensor data 148 may be provided in real-time to offsite user devices 120 such that offsite personnel may view real-time status of the drilling rig 102 and provide feedback based on the real-time sensor data. For example, different portions of the encrypted sensor data 146 may be sent to offsite user devices 120. In some embodiments, encrypted sensor data may be decrypted by the rig computing resource environment 105 before transmission or decrypted on an offsite user device after encrypted sensor data is received.

The offsite user device 120 may include a thin client configured to display data received from the rig computing resource environment 105 and/or the remote computing resource environment 106. For example, multiple types of thin clients (e.g., devices with display capability and minimal processing capability) may be used for certain functions or for viewing various sensor data.

The rig computing resource environment 105 may include various computing resources used for monitoring and controlling operations such as one or more computers having a processor and a memory. For example, the coordinated control device 104 may include a computer having a processor and memory for processing sensor data, storing sensor data, and issuing control commands responsive to sensor data. As noted above, the coordinated control device 104 may control various operations of the various systems of the drilling rig 102 via analysis of sensor data from one or more drilling rig systems (e.g. 110, 112, 114) to enable coordinated control between each system of the drilling rig 102. The coordinated control device 104 may execute control commands 150 for control of the various systems of the drilling rig 102 (e.g., drilling rig systems 110, 112, 114). The coordinated control device 104 may send control data determined by the execution of the control commands 150 to one or more systems of the drilling rig 102. For example, control data 152 may be sent to the downhole system 110, control data 154 may be sent to the fluid system 112, and control data 154 may be sent to the central system 114. The control data may include, for example, operator commands (e.g., turn on or off a pump, switch on or off a valve, update a physical property setpoint, etc.). In some embodiments, the coordinated control device 104 may include a fast control loop that directly obtains sensor data 140, 142, and 144 and executes, for example, a control algorithm. In some embodiments, the coordinated control device 104 may include a slow control loop that obtains data via the rig computing resource environment 105 to generate control commands.

In some embodiments, the coordinated control device 104 may intermediate between the supervisory control system 107 and the controllers 126, 132, and 138 of the systems 110, 112, and 114. For example, in such embodiments, a supervisory control system 107 may be used to control systems of the drilling rig 102. The supervisory control system 107 may include, for example, devices for entering control commands to perform operations of systems of the drilling rig 102. In some embodiments, the coordinated control device 104 may receive commands from the supervisory control system 107, process the commands according to a rule (e.g., an algorithm based upon the laws of physics for drilling operations), and/or control processes received from the rig computing resource environment 105, and provides control data to one or more systems of the drilling rig 102. In some embodiments, the supervisory control system 107 may be provided by and/or controlled by a third party. In such embodiments, the coordinated control device 104 may coordinate control between discrete supervisory control systems and the systems 110, 112, and 114 while using control commands that may be optimized from the sensor data received from the systems 110 112, and 114 and analyzed via the rig computing resource environment 105.

The rig computing resource environment 105 may include a monitoring process 141 that may use sensor data to determine information about the drilling rig 102. For example, in some embodiments the monitoring process 141 may determine a drilling state, equipment health, system health, a maintenance schedule, or any combination thereof. In some embodiments, the rig computing resource environment 105 may include control processes 143 that may use the sensor data 146 to optimize drilling operations, such as, for example, the control of drilling equipment to improve drilling efficiency, equipment reliability, and the like. For example, in some embodiments the acquired sensor data may be used to derive a noise cancellation scheme to improve electromagnetic and mud pulse telemetry signal processing. The control processes 143 may be implemented via, for example, a control algorithm, a computer program, firmware, or other suitable hardware and/or software. In some embodiments, the remote computing resource environment 106 may include a control process 145 that may be provided to the rig computing resource environment 105.

The rig computing resource environment 105 may include various computing resources, such as, for example, a single computer or multiple computers. In some embodiments, the rig computing resource environment 105 may include a virtual computer system and a virtual database or other virtual structure for collected data. The virtual computer system and virtual database may include one or more resource interfaces (e.g., web interfaces) that enable the submission of application programming interface (API) calls to the various resources through a request. In addition, each of the resources may include one or more resource interfaces that enable the resources to access each other (e.g., to enable a virtual computer system of the computing resource environment to store data in or retrieve data from the database or other structure for collected data).

The virtual computer system may include a collection of computing resources configured to instantiate virtual machine instances. A user may interface with the virtual computer system via the offsite user device or, in some embodiments, the onsite user device. In some embodiments, other computer systems or computer system services may be utilized in the rig computing resource environment 105, such as a computer system or computer system service that provisions computing resources on dedicated or shared computers/servers and/or other physical devices. In some embodiments, the rig computing resource environment 105 may include a single server (in a discrete hardware component or as a virtual server) or multiple servers (e.g., web servers, application servers, or other servers). The servers may be, for example, computers arranged in any physical and/or virtual configuration.

In some embodiments, the rig computing resource environment 105 may include a database that may be a collection of computing resources that run one or more data collections. Such data collections may be operated and managed by utilizing API calls. The data collections, such as sensor data, may be made available to other resources in the rig computing resource environment or to user devices (e.g., onsite user device 118 and/or offsite user device 120) accessing the rig computing resource environment 105. In some embodiments, the remote computing resource environment 106 may include similar computing resources to those described above, such as a single computer or multiple computers (in discrete hardware components or virtual computer systems).

Figure 5:
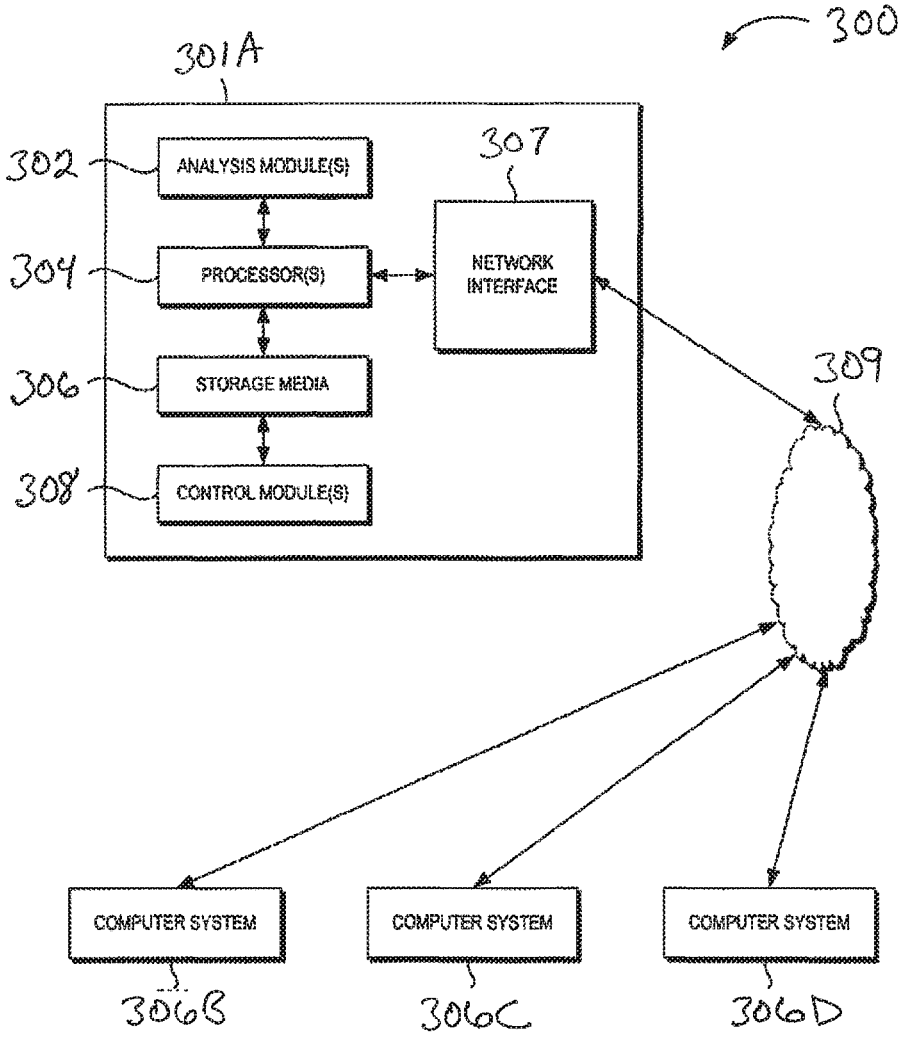
FIG. 5 illustrates a schematic view of a computing system.

In some embodiments, the methods of the present disclosure may be executed by a computing system. FIG. 5 illustrates an example of such a computing system 300, in accordance with some embodiments. The computing system 300 may include a computer or computer system 301A, which may be an individual computer system 301A or an arrangement of distributed computer systems. The computer system 301A includes one or more analysis modules 302 that are configured to perform various tasks according to some embodiments, such as one or more methods disclosed herein. To perform these various tasks, the analysis module 302 executes independently, or in coordination with, one or more processors 304, which is (or are) connected to one or more storage media 306. The processor(s) 304 is (or are) also connected to a network interface 307 to allow the computer system 301A to communicate over a data network 309 with one or more additional computer systems and/or computing systems, such as 301B, 301C, and/or 301D (note that computer systems 301B, 301C and/or 301D may or may not share the same architecture as computer system 301A, and may be located in different physical locations, e.g., computer systems 301A and 301B may be located in a processing facility, while in communication with one or more computer systems such as 301C and/or 301D that are located in one or more data centers, and/or located in varying countries on different continents).

A processor may include a microprocessor, microcontroller, processor module or subsystem, programmable integrated circuit, programmable gate array, or another control or computing device.

The storage media 306 may be implemented as one or more computer-readable or machine-readable storage media. Note that while in the example embodiment of FIG. 5 storage media 306 is depicted as within computer system 301A, in some embodiments, storage media 306 may be distributed within and/or across multiple internal and/or external enclosures of computing system 301A and/or additional computing systems. Storage media 306 may include one or more different forms of memory including semiconductor memory devices such as dynamic or static random access memories (DRAMs or SRAMs), erasable and programmable read-only memories (EPROMs), electrically erasable and programmable read-only memories (EEPROMs) and flash memories, magnetic disks such as fixed, floppy and removable disks, other magnetic media including tape, optical media such as compact disks (CDs) or digital video disks (DVDs), BLUERAY® disks, or other types of optical storage, or other types of storage devices. Note that the instructions discussed above may be provided on one computer-readable or machine-readable storage medium, or alternatively, may be provided on multiple computer-readable or machine-readable storage media distributed in a large system having possibly plural nodes. Such computer-readable or machine-readable storage medium or media is (are) considered to be part of an article (or article of manufacture). An article or article of manufacture may refer to any manufactured single component or multiple components. The storage medium or media may be located either in the machine running the machine-readable instructions, or located at a remote site from which machine-readable instructions may be downloaded over a network for execution.

In some embodiments, the computing system 300 contains one or more rig control module(s) 308. In the example of computing system 300, computer system 301A includes the rig control module 308. In some embodiments, a single rig control module may be used to perform some or all aspects of one or more embodiments of the methods disclosed herein. In alternate embodiments, a plurality of rig control modules may be used to perform some or all aspects of methods herein.

It should be appreciated that computing system 300 is only one example of a computing system, and that computing system 300 may have more or fewer components than shown, may combine additional components not depicted in the example embodiment of FIG. 5, and/or computing system 300 may have a different configuration or arrangement of the components depicted in FIG. 5. The various components shown in FIG. 5 may be implemented in hardware, software, or a combination of both hardware and software, including one or more signal processing and/or application specific integrated circuits.

Further, the steps in the processing methods described herein may be implemented by running one or more functional modules in information processing apparatus such as general purpose processors or application specific chips, such as ASICs, FPGAs, PLDs, or other appropriate devices. These modules, combinations of these modules, and/or their combination with general hardware are all included within the scope of protection of the invention.

High amplitude rotational oscillations of the drillstring are generated by the combination of the torque generated by the interaction of the bit with the hole-bottom and of the drillstring with the borehole walls, and the lack of damping of the rotational oscillations. To damp the oscillations, the torque at the bit may need to rise as the rotation speed rises. If the torque declines with increased rotation speed this will increase the amplitude of the oscillations. Although drill bit torque may decline with increased rotary speed, even if the rig torque is not increasing with rotary speed, the effect of a weight control system may result in the drill bit torque, on average, being higher at higher rotary speed.

Generally, drill bit torque increases as weight applied to the bit increases, and drill bit torque decreases as weight-on-bit (WOB) decreases. The drillstring is elastic. Thus, if the rate-of-penetration (ROP) of the bit exceeds the rate at which the drillstring is being lowered into the borehole at the drill rig, the weight-on-bit will be reduced and hence the torque will reduce. Similarly, if the drillstring is lowered into the hole at the drill rig faster than the drill bit is advancing (ROP), the weight-on-bit and drill bit torque will increase. Since high and low bit rotation speeds coincide with high and low rates-of-penetration, on average, the torque will be reduced when the bit rotates faster, and increased when the bit rotates slower, leading to increased oscillations.

Downhole measurement of rotation speed cannot be used to increase weight from surface, thereby also increasing torque, as even if the information is transmitted instantaneously to surface, there is time needed for the changes at surface to be felt down hole (axial waves travel down the drillstring at slightly less than 5 km/s); however if the downhole rotation speed can be anticipated from surface measurements, then because the axial waves travel faster than rotational waves (about 3 km/s), there is enough time to make surface measurements, apply some signal processing and modify the weight-on-bit so that the anticipated change in rotation speed and change in weight occur simultaneously (or near enough).

At the surface, through a combination of the action of the top drive (or other means of rotating the drillstring) and the reflection of rotational waves travelling up the drillstring, downgoing rotational waves are created which will ultimately result in the drill bit changing rotation speed. Downgoing and upgoing waves may be separated at surface by taking appropriate linear combinations of the torque and rotation speed. The downgoing wave $\omega_d$ may be defined by $$\omega_d = \frac{1}{2}\left(\omega_s + \frac{T_s}{z}\right) \tag{1}$$

where $\omega_s$ is the surface rotation speed, $T_s$ is the surface torque and z is the rotational impedance of the drill pipe at the surface.

If the downgoing wave is increased, then after a delay corresponding to the travel time for rotational waves down the drill pipe, the BHA and drill bit rotation speed will, in general, also increase. By estimating the downgoing wave from measurements (using equation 1) and then adjusting the target weight-on-bit for the autodriller, the downhole weight-on-bit (and hence drill bit torque) can be increased when the bit rotation speed increases. Because the downgoing wave may be compared against its average value, it should first be high-pass filtered (to remove the average) above a frequency which is low compared to the resonant time of the system, and preferably also low-pass filtered at some suitable frequency which is well above the resonant frequency of the system. Because filtering (especially low-pass filtering) introduces delays, there are constraints in what filters can be applied, wherein the filtered data may be acted on after only a short delay, which may take into account the delay introduced by filtering. Additionally, if there are delays, both electronic and mechanical, between the autodriller changing set-point and the travelling block position starting to move, this may also be included.

The time it takes for rotational and axial waves to travel from the surface to the downhole BHA may be included in the algorithm. This may be measured on the rig, or estimated using simulations of the behavior of the drillstring, or by a combination of the two. To measure wave travel time for both the weight (axial waves) and torque (rotational waves), an action or actions may be taken at the surface that generates axial waves for which a response can be measured by the bit or BHA. One such action is to move the travelling block downwards, which will generate additional weight-on-bit (axial) and a corresponding increase in torque (rotational). The time difference between the effects of the action being seen on the surface weight and the surface torque is the same as the wave travel time required for the algorithm. Rather than simply taking one action, if the block is lowered in a series of non-periodic steps, or other rate-changes, and the weight and torque signals at surface are correlated, the time at which maximum correlation occurs will be the wave travel time required.

Alternatively, the same method may be employed using a simulation of the drillstring. This time difference will grow as the drillstring is lengthened through drilling. While the time difference may have been estimated once, it may again be estimated every time the drillstring length changes. Simulation can be used to estimate the change in time difference with the addition of a pipe stand (lengthened drillstring), and this estimated change may be made either to the simulated or measured time difference. Alternatively, the time difference can be measured on two or more occasions, and then linear extrapolation may be used to adjust the time difference as a pipe stand is added to the drillstring (lengthened drillstring). Linear extrapolation may be valid so long as the same kind of drill pipe is being added to the top of the drillstring.

Automated control may control movement of the travelling block. Preferably, the control should be fast, such as with an electromechanical brake. Conventional measurement of the hookload and torque can be used. But if the time delay is estimated using measurement data, the hookload may preferrably be measured by sensors located close to the top of the drillstring rather than inferred by conventional means from the deadline anchor tension, as there may be a delay between the two measurements.

Figure 6:
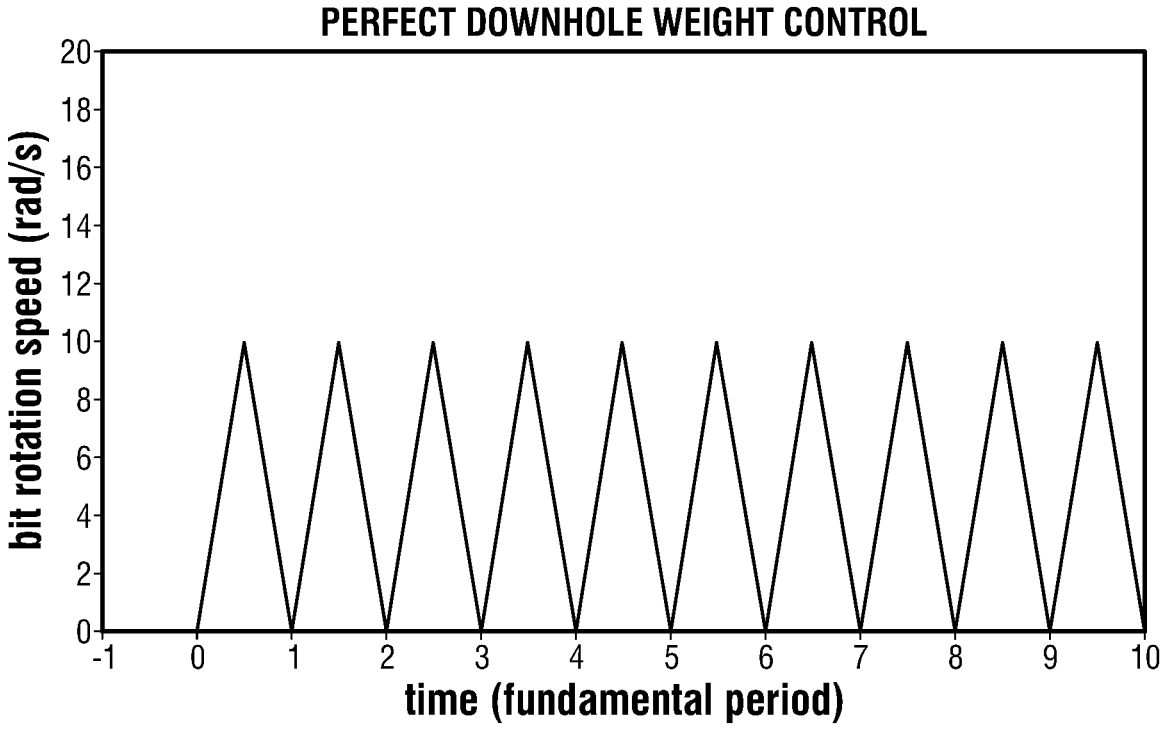
FIG. 6 shows a data curve defined by a torque in the drillstring at the drill rig versus the weight of the drillstring on the drill rig WOB for a simulated of bit stick-slip, where the downhole weight on bit is perfectly controlled to be constant.

FIG. 6 shows a simulation of bit stick-slip, where the downhole weight-on-bit is perfectly controlled to be constant. The plot shows the rotation speed of the bit versus time, where the time is normalized by the period of the fundamental oscillation of the drillstring (four times the travel time of rotational waves from the bit to the surface). The model is completely loss-less.

Figure 7:
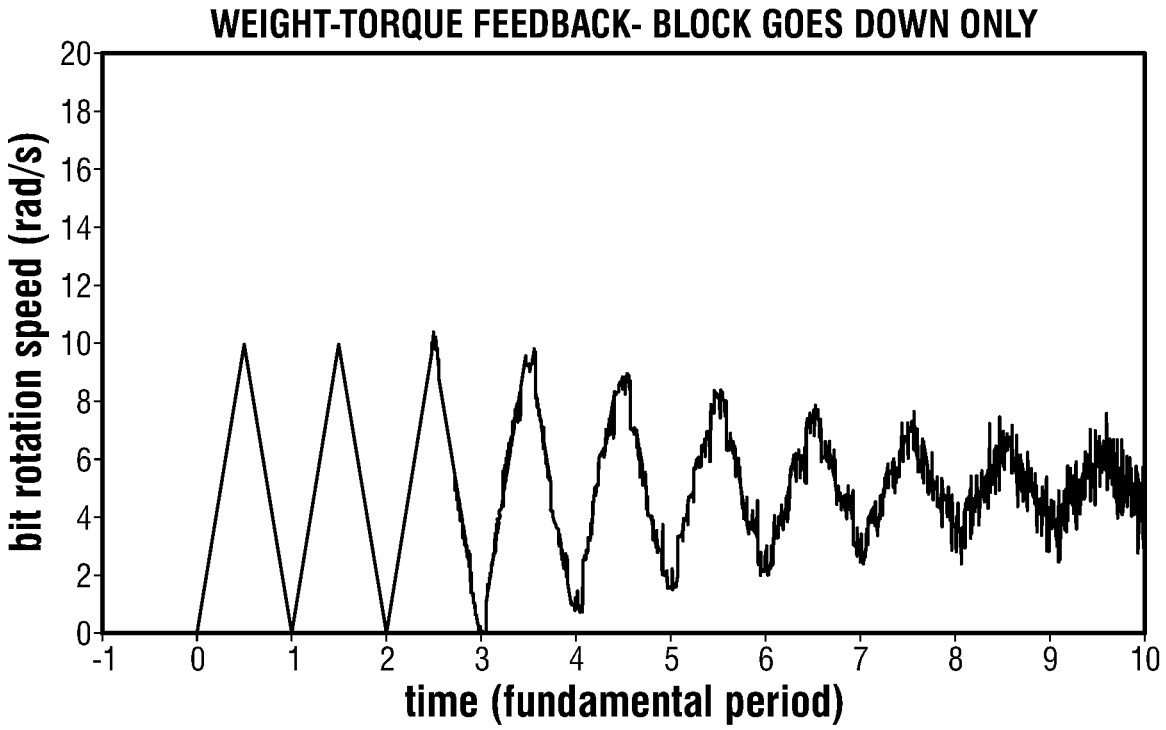
FIG. 7 shows a simulation of the effect of feeding a multiple of the downhole rotational wave (with correct delay) into the controller of the weight of the drillstring on the drill rig WOB.

FIG. 7 shows a simulation of the effect of feeding a multiple of the downhole rotational wave, with the correct delay, into the surface weight-on-bit control. Because the surface rotation speed is constant, this is equivalent to using simply the torque as a feedback signal. In this simple simulation, there is some high frequency noise introduced that in reality would be damped. It should be noted that for most drilling rigs, where the descent of the drillstring is controlled by a brake, the travelling block can only move downwards, not upwards, so the auto-driller cannot maintain exactly the desired surface weight-on-bit in some circumstances if the desired weight reduces too fast. In FIG. 7, this constraint is included, but never-the-less the oscillations are reduced in an effective manner. The invention can be applied both in these circumstances, and on rigs where the travelling block can both rise and fall during drilling.

The exact multiple of the torque that should be fed back into the weight signal depends on the characteristics of the bit, such as the bit type and the bit radius. The method may be more effective for fixed cutter bits, for which the slope of the torque versus weight curve is higher. The typical gradient of the torque against weight can either be established by tests on the bit, by data acquired during drilling, or by modelling, or a combination of these methods. Once the torque against weight is known, and the typical size of the fluctuations in_surface torque are known, the size of the feedback can be set so that the average amount of variation is a chosen proportion of the average weight-on-bit, for instance 5% or 10%. The invention can be initiated voluntarily by the driller or others at the rig, or located remotely. Alternatively, if the existence of sustained high-amplitude rotational oscillations is automatically detected, for instance from the downhole rotation speed measurements which are transmitted to surface (e.g. maximum, minimum and average speed over a period), or from an estimation based on the variation in the surface torque, the method can be initiated automatically, or initiation can be suggested to supervising personnel to be confirmed. Downhole measurements can also be used to adapt the parameters of the algorithm, thus if the additional weight-on-bit variation results in inadequate reduction in variation in downhole rotation speed, the amplitude can be increased, and if the variation is not having the desired effect, it can be terminated.

Figure 8:
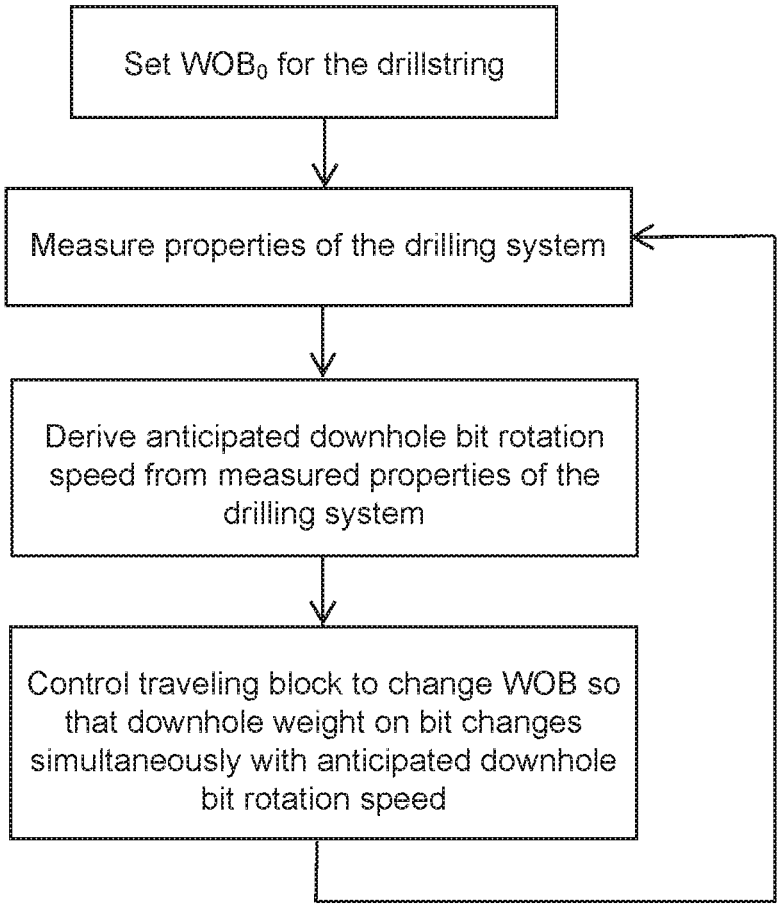
FIG. 8 is a flow chart for an algorithm for controlling the weight of the drillstring on the drill rig WOB so that the downhole weight of the drillstring on the drill bit changes simultaneously with an anticipated change of the downhole drill bit rotation speed.

FIG. 8 shows a basic flow diagram for a drilling control method in accordance with an embodiment of the present disclosure that implements a control algorithm based on equation (1). In some embodiments, after an initial weight of the drillstring on the drill rig $WOB_0$ is set in the first step, the algorithm loops around the subsequent steps at a repeat interval that is sufficiently short that the steps are repeated multiple times during the dominant rotational resonance of the system. When the system is activated, the value of the WOB multiplier is initially set to zero or close to zero and subsequently increases until it reaches a chosen value. In some embodiments, this method of gradual activation may reduce variation in system behavior in the drilling system.

The variation in weight-on-bit can be carried out simultaneously with methods to reduce rotational oscillation employing varying the controlled surface rotation speed (e.g. WO/2014/147575, incorporated in its entirety herein by reference) or other methods which modify the action of the rotational drive controller in order to suppress rotational oscillations. The two methods may act constructively with increased effectiveness.

For example, the present invention may be used in combination with other methods to mitigate stick-slip. An example of an algorithm for controlled surface rotation speed to reduce rotational oscillation at the drill bit is as follows, which may be used in combination with an algorithm for sensing the downgoing rotation speed at surface and modifying the WOB coming from the surface with an appropriate delay so that it will arrive at the same time as changes in downgoing rotation speed. Controlled surface rotation speed to reduce rotational oscillation may be used to achieve a desired rotation speed at the surface ($v_0$) while minimizing the amount of downgoing rotational energy ($v_{down}$). This formulation fits well as an outer control system driving a fast, built-in control system for the top drive which is attempting to achieve a particular rotation speed. Modern PI top-drive controllers (combined with high power top-drives) can maintain very tight control over rotation speed.

Viewed as a minimization constraint this can be written as minimizing E where $$E = (v - v_0)^2 + \lambda v_{down}^2 = (v - v_0)^2 + \lambda(v - v_{up})^2 \quad (2)$$

Where v, the rotation speed to be fed to the top-drive, is the sum of $v_{up}$ and $v_{down}$, and λ is a constant, and reflects the relative weight given to the two contradictory objectives.

The up-going component of the rotation speed can be estimated from simultaneous surface measurements of the rotation speed and torque (T). If z is the rotational impedance of the pipe (this can be calculated sufficiently accurately from pipe dimension) at the surface, then the downgoing and upgoing components are $$v_{down} = \frac{1}{2}\left(v + \frac{T}{z}\right)$$

$$v_{up} = \frac{1}{2}\left(v - \frac{T}{z}\right)$$

The solution to equation (2) is $$v = \frac{v_0 + \lambda v_{up}}{1 + \lambda}$$

However, since this results in a slower mean rotation speed than desired, we rewrite the minimization constraint as $$E=(v-(1+\lambda)v_0)^2+\lambda v_{down}^2$$

Whose solution is $$v = v_0 + \frac{\lambda}{1+\lambda} v_{up}$$

The long-term average of the rotation speed will still not be quite correct, so in addition we can add a term r, $$v(t) = r(t) + v_0(t) + \frac{\lambda}{1+\lambda} v_{up}(t) \quad (3)$$

$$\text{Where } \frac{dr}{dt} = \frac{1}{k}(v - v_0)$$

And k is chosen so that it is long compared to the resonance time of the system (e.g., 1/60s). In discrete time, with sampling interval δ this filter is trivial to implement $$r_j=r_{j-1}+k\delta(v_j-v_{0(j)})$$

An alternative is to high-pass filter the signal $v_{up}$ used in equation (3). This can also be done using a simple one-pole filter, with the same value of k.

$$v_{up_j}^{l}=(1-k\delta)v_{up_{j-1}}^{l}+k\delta v_{up_j}$$

$$v_{up_j}^{h}=v_{up_j}-v_{up_j}^{l}$$

A good value of λ to use in equation (3) is 1. Obviously this parameter controls how much reduction in rotational resonance is being attempted. Set to zero, and there is no control.

There are two final twists to the algorithm. In order to avoid sending high-frequency noise to the top-drive controller that may interact with the internal control algorithm, the estimate of the upgoing rotation speed can be low-pass filtered. This can be done in exactly the same as was done for r, but with a larger value of k—chosen so that it does not filter out the main rotational resonance of the drillstring. A suitable value is 10/s.

$$v_{up_j}^{f}=(1-k\delta)v_{up_{j-1}}^{f}+k\delta v_{up_j}$$

Secondly, if the bit sticks hard, it is possible for the drillstring rotation to stop completely. To avoid this, a minimum value of v can be imposed, for instance 25% less than the desired value $v_0$.

Rewriting equation (3)

$$v_j = r_j + v_{0(j)} + \frac{\lambda}{1+\lambda} v_{up_{j-1}}^{f}$$

Figure 9:
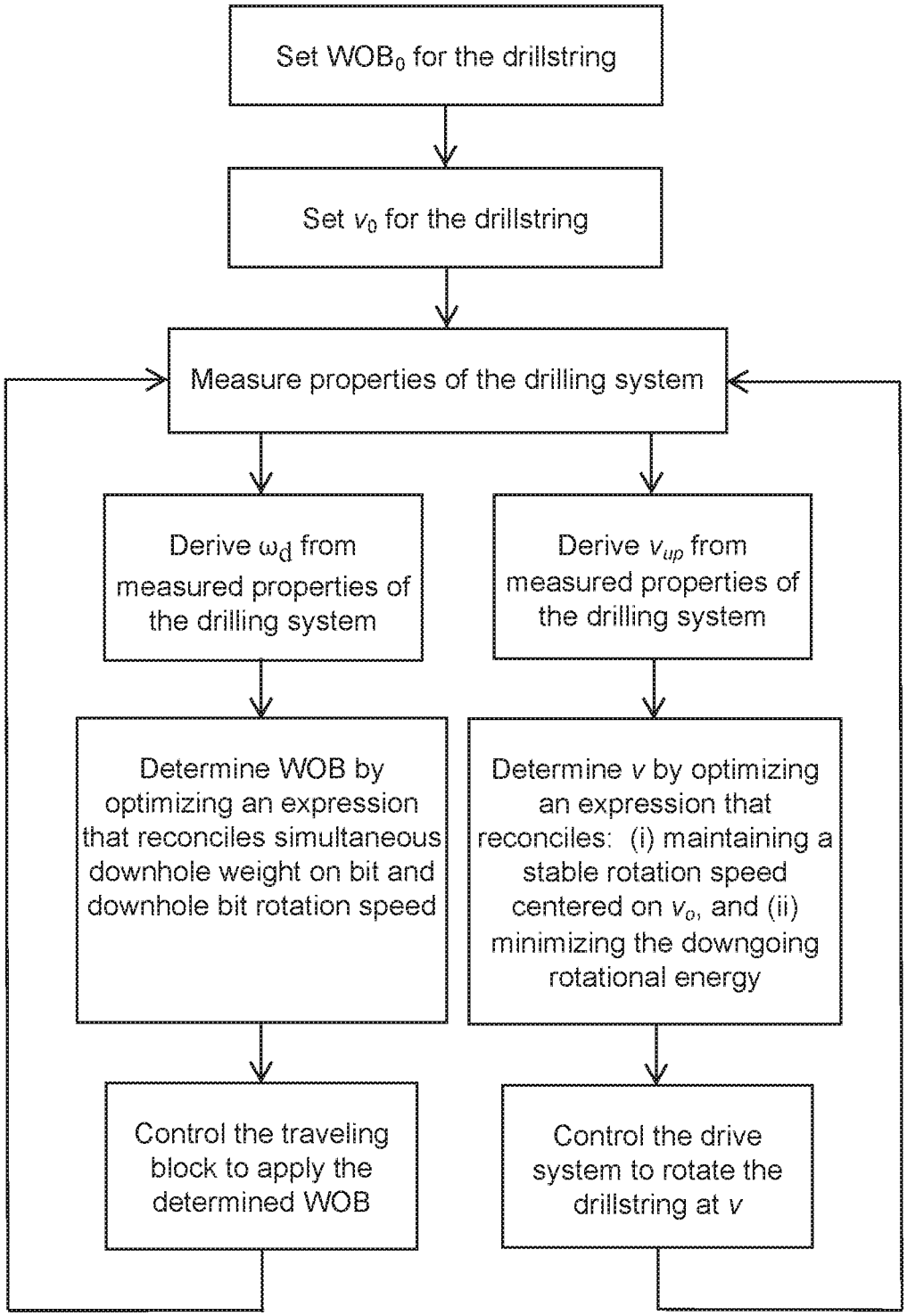
FIG. 9 is a flow chart for an algorithm for controlling the weight of the drillstring on the drill rig WOB and a method to reduce rotational oscillation of the drill bit by varying the controlled rotation speed of the drillstring via a drive system.

FIG. 9 shows a flow diagram for a drilling control method that implements a combination of control algorithms based on equations (1) and (3). After $WOB_0$ and $v_0$ are set in the first steps, the algorithm loops around the subsequent steps at a repeat interval that is sufficiently short that the steps are repeated multiple times during the dominant rotational resonance of the system. When the system is activated, the value of the WOB multiplier and λ are initially set to zero or close to zero and subsequently increased until they reach chosen values. In some embodiments, this method of gradual activation may reduce variation in system behavior in the drilling system.

In alternative embodiments, drilling control methods implements a combination of control algorithms based at least one of the algorithms disclosed in this specification with any other knows control algorithm. It is specifically contemplated that control algorithms are implemented in combination.

Although the disclosed embodiments are described in detail in the present disclosure, it should be understood that various changes, substitutions and alterations can be made to the embodiments without departing from their spirit and scope.

What is claimed:

1. A method for drilling a wellbore with a drill rig, the method comprising:

rotating a drillstring and a drill bit with a drill rig drive system;

applying an initial weight of the drillstring on the drill rig WOB;

measuring drill rig properties to derive an anticipated drill bit rotation speed;

changing the weight of the drillstring on the drill rig WOB so that a corresponding change to the downhole weight on the drill bit occurs approximately simultaneously with a change in the anticipated drill bit rotation speed;

determining for the drill bit the slope of a data curve defined by a torque in the drillstring at the drill rig versus the weight of the drillstring on the drill rig WOB via at least one method selected from: tests on the drill bit, data acquired during drilling with the drill bit, and modelling the drill bit during a modelled drilling operation; and determining a size of fluctuations in the torque in the drillstring at the drill rig, wherein the changing the weight of the drillstring on the drill rig WOB comprises changing by a selected percentage of the average weight of the drillstring on the drill rig WOB.

2. A method for drilling a wellbore as claimed in claim 1, wherein the percentage is between about 5% and about 10%.

3. A method for drilling a wellbore with a drill rig, the method comprising:

rotating a drillstring and a drill bit with a drill rig drive system;

applying an initial weight of the drillstring on the drill rig WOB, measuring drill rig properties to derive an anticipated drill bit rotation speed; and changing the weight of the drillstring on the drill rig WOB so that a corresponding change to the downhole weight on the drill bit occurs approximately simultaneously with a change in the anticipated drill bit rotation speed, wherein the changing the weight of the drillstring on the drill rig WOB further comprises: controlling a WOB control target that is a predetermined signal summed with a signal derived from a delayed linear combination of measurements made of the drill string surface rotation speed and torque, wherein the delay is the difference between rotational and axial propagation times from the surface to the proximity of the bit.

4. A method for drilling a wellbore as claimed in claim 3, wherein the difference between rotation and axial propagation time is determined using correlation of measurements made at the surface.

5. A method for drilling a wellbore as claimed in claim 3, wherein the difference between rotation and axial propagation time is determined using simulation.

6. A method for drilling a wellbore as claimed in claim 3, wherein the difference between rotation and axial propagation time is determined using correlation of measurements made at the surface augmented by simulation.

7. A method for drilling a wellbore as claimed in claim 3, wherein the signal derived from a delayed linear combination of measurements is high-pass filtered above a first predetermined frequency, wherein the first predetermined frequency is lower than a resonant frequency of the system.

8. A method for drilling a wellbore as claimed in claim 3, wherein the signal derived from a delayed linear combination of measurements is low-pass filtered below a second predetermined frequency, wherein the second predetermined frequency is higher than a resonant frequency of the system.

9. An autodriller for controlling a drill rig system having a drillstring and a drill bit, the autodriller comprising:

a rotation receptor that receives a signal corresponding to drillstring rotation speed at the drill rig;

a processor;

a non-transitory storage medium; and a set of computer readable instructions stored in the non-transitory storage medium, wherein when the instructions are executed by the processor allow the autodriller to:

apply an initial weight of the drillstring on the drill rig WOB;

measure drill rig properties to derive an anticipated drill bit rotation speed; and change the weight of the drillstring on the drill rig WOB so that a corresponding change to the downhole weight on the drill bit occurs approximately simultaneously with a change in the anticipated drill bit rotation speed, wherein the set of computer readable instructions further comprises instructions when executed by the processor to allow the autodriller to:

determine for the drill bit the slope of a data curve defined by a torque in the drillstring at the drill rig versus the weight of the drillstring on the drill rig WOB via at least one method selected from: tests on the drill bit, data acquired during drilling with the drill bit, and modelling the drill bit during a modelled drilling operation; and determine a size of fluctuations in the torque in the drillstring at the drill rig, and wherein the set of computer readable instructions further comprises instructions when executed by the processor to allow the autodriller to: change the weight of the drillstring on the drill rig WOB by a selected percentage of the average weight of the drillstring on the drill rig WOB.

10. An autodriller for controlling a drill rig system as claimed in claim 9, wherein the percentage is between about 5% and about 10%.

11. An autodriller for controlling a drill rig system having a drillstring and a drill bit, the autodriller comprising:

a rotation receptor that receives a signal corresponding to drillstring rotation speed at the drill rig;

a processor;

a non-transitory storage medium; and a set of computer readable instructions stored in the non-transitory storage medium, wherein when the instructions are executed by the processor allow the autodriller to:

apply an initial weight of the drillstring on the drill rig WOB;

measure drill rig properties to derive an anticipated drill bit rotation speed; and change the weight of the drillstring on the drill rig WOB so that a corresponding change to the downhole weight on the drill bit occurs approximately simultaneously with a change in the anticipated drill bit rotation speed, wherein the set of computer readable instructions stored in the non-transitory storage medium, when executed by the processor, further allow the autodriller to change the weight of the drillstring on the drill rig WOB by:

controlling a WOB control target that is a predetermined signal summed with a signal derived from a delayed linear combination of measurements made of the drill string surface rotation speed and torque, wherein the delay is the difference between rotational and axial propagation times from the surface to the proximity of the bit.

12. An autodriller for controlling a drill rig system as claimed in claim 11, wherein the difference between rotation and axial propagation time is determined using correlation of measurements made at the surface.

13. An autodriller for controlling a drill rig system as claimed in claim 11, wherein the difference between rotation and axial propagation time is determined using simulation.

14. An autodriller for controlling a drill rig system as claimed in claim 11, wherein the difference between rotation and axial propagation time is determined using correlation of measurements made at the surface augmented by simulation.

15. An autodriller for controlling a drill rig system as claimed in claim 11, wherein the signal derived from a delayed linear combination of measurements is high-pass filtered above a first predetermined frequency, wherein the first predetermined frequency is lower than a resonant frequency of the system.

16. An autodriller for controlling a drill rig system as claimed in claim 11, wherein the signal derived from a delayed linear combination of measurements is low-pass filtered below a second predetermined frequency, wherein the second predetermined frequency is higher than a resonant frequency of the system.

* * * * *